US005355562A

United States Patent [19]

Matoba et al.

[11] Patent Number: 5,355,562

[45] Date of Patent: Oct. 18, 1994

[54] BUCKLE

[75] Inventors: Hiroshi Matoba; Ryukichi Murai, both of Toyama, Japan

[73] Assignee: Yoshida Kogyo K.K., Tokyo, Japan

[21] Appl. No.: 120,527

[22] Filed: Sep. 14, 1993

[30] Foreign Application Priority Data

Sep. 17, 1992 [JP] Japan ..... 4-071473[U]
Sep. 17, 1992 [JP] Japan ..... 4-071474[U]
Dec. 30, 1992 [JP] Japan ..... 4-093534[U]

[51] Int. Cl.[5] ..... A44B 11/00

[52] U.S. Cl. ..... 24/625; 24/615; 24/664

[58] Field of Search ..... 24/625, 664, 633, 618, 24/616, 615

[56] References Cited

U.S. PATENT DOCUMENTS 1,361,645 12/1920 Tomchin ..... 24/625
3,430,306 3/1969 Tareau ..... 24/625
4,672,725 6/1987 Kasai .
4,987,661 1/1991 Kasai ..... 24/625

FOREIGN PATENT DOCUMENTS 61-202212 12/1986 Japan .
2-19304 2/1990 Japan .
2-33614 3/1990 Japan .

*Primary Examiner*—Victor N. Sakran
*Attorney, Agent, or Firm*—Hill, Steadman & Simpson

[57] ABSTRACT

A buckle includes a triangular projection provided on a male member for deflecting a resilient force of a resilient member toward a direction of removal of the male member. When locking elements of the male member are disengaged from retaining elements of a female member in response to the movement of a pair of actuating members, the triangular projection is operated to thrust out the male member from the female member under the resiliency of the resilient member. Thus, the buckle can be detached with one hand.

23 Claims, 7 Drawing Sheets

BUCKLE

BACKGROUND OF THE INVENTION

1. Field of the Invention

The present invention relates to a buckle used as a clasp fastener for belts, suspenders for trousers, or straps on bags.

2. Description of the Prior Art

One prior buckle shown in Japanese Utility Model Laid-open Publication No. 2-19304 comprises a male member and a female member that are releasably coupled together to connect loose ends of a belt. The male member includes a pair of hook-like locking members. The female member includes a pair of actuating members each having a hook-like retaining portion. The actuating members are slidably mounted and linearly reciprocate toward and away from each other. A pair of coil springs urges the actuating members, respectively, in a direction away from each other. The sliding direction of the actuating members is restricted by guide portions which are formed by a pair of interior side surfaces of the female member. The female member further has a pair of stopper portions engageable with respective one end portions of the actuating members to retain the forces of the coil springs exerted on the actuating members.

To engage the buckle, the male member is inserted into the female member until the locking members are latched by the corresponding retaining portions. In this instance, since the actuating members are urged in a direction away from each other by the forces of the coil springs, the locking members are interlocked with the retaining portions. To disengage the buckle, the actuating members are forced inwardly toward each other against the forces of the coil springs until the locking members are released from the retaining portions. The male member is thus allowed to be detached from the female member. Then, the male member is pulled out from the female member to disengage the buckle.

In Japanese Utility Model Laid-open Publication No. 61-202212 corresponding to U.S. Pat. No. 4,672,725 granted Jun. 16, 1987 to Kasai, there is disclosed another prior buckle which is composed of a male member having a pair of resiliently deformable legs, and a female member having a pair of fixed retaining portions. The legs are interlocked with the retaining portions to couple together the male and female members. Thus, the legs serve as locking members. When the male and female members are to be disengaged, two confronting presser portions of the female member are pressed toward each other to resiliently deform or flex the front ends of the legs inwardly until the legs are released from the retaining portions. The male and female members are then pulled apart to disengage the buckle.

Still another prior buckle shown in Japanese Utility Model Laid-open Publication No. 2-33614 includes a female member having a pair of pivotally movable actuating members each provided with a retaining portion. The retaining portions of the respective actuating members are engageable with a pair of locking members of a male member, respectively, to couple the male and female members. When the male and female members are to be disengaged, the actuating members are pivoted in one direction to release the locking members from the retaining portions. The actuating members are urged in the opposite direction by a resilient member. In order to limit the angular movement of the actuating members toward the opposite direction, the female member includes a pair of stopper portions which are engageable with the actuating members, respectively.

In the prior buckle shown in the first-mentioned Japanese publication, the forces of the coil springs act only in a direction parallel to the direction of movement of the actuating members. As a result, due to a play resulting from the working tolerance between the locking members and the retaining portions, the male and female members being coupled together tend to wobble particularly in a direction perpendicular to the direction of movement of the actuating members. The play, however, cannot be practically dispensed with and is indispensable to facilitate a smooth and reliable engagement between the male and female members. In addition, when the buckle is to be disengaged, the male member is pulled out from the female member with one hand of the user while the actuating members are being pressed by the other hand. Thus, both hands of the user are occupied when the buckle is disengaged. Furthermore, the forces of the coil springs, which act in a direction parallel to the direction of movement of the actuating members, are born by the stopper portions which retain respectively thereon one end portions of the actuating members. With this construction, each of the actuating members, as it is manipulated, produces a moment of force or torque which will increase a friction between the actuating member and the corresponding guide portion. Because of the increased friction, sliding surfaces and a coating layer, if any, are worn off irregularly. In addition, the movement of the actuating members becomes sluggish and, hence, smooth attaching and detaching operations of the buckle are difficult to achieve. Furthermore, it occurs likely that the actuating members and the coil springs are assembled in an unstable condition. The thus assembled actuating members are likely to tilt while the buckle is in use.

In the prior buckle disclosed in the second-mentioned Japanese publication, the resilient legs of the male member must be long enough to possess a certain degree of resiliency. The male member having such resilient legs is relatively large in size and enlarges the overall size of the buckle particularly in the longitudinal direction of the legs. In addition, since the legs and the retaining portions are not interlocked resiliently, the male and female members are permitted to cause wobbling. When the buckle is to be disengaged, the presser portions are compressed to resiliently flex the legs toward each until the legs are released from interlocking engagement with the retaining portions. When released, the legs tend to thrust out from the female member due to the resilient forces stored in the legs. In this instance, however, since the retaining portions extend in a direction perpendicular to the acting directions of the resilient forces, a certain muscle effort is needed in order to separate the male and female member against a friction between the legs and the retaining portions. In practice, the male member is pulled out from the female member by one hand of the user while the presser portions are being compressed by the opposite hand.

In the prior buckle shown in the last-mentioned Japanese publication, each of the actuating members is pivoted at one end thereof. There is no means provided for guiding the corresponding actuating member as it undertake a pivotal motion. Accordingly, the actuating members are unstable in operation. In addition, the female member includes a base plate and a cover plate attached together, with the actuating members and the resilient member held between the base and cover plates. When assembling the female member, the actuating members and the resilient member are placed on the base plate. In this instance, however, due to the resilient force acting on the actuating members, the actuating members are the resilient member are likely to displace and sometimes detached from the base plate before the cover plate is attached to the base plate.

SUMMARY OF THE INVENTION

With the foregoing difficulties in view, it is an object of the present invention to provide a buckle including a male member and a female member which can be firmly coupled together without wobbling and can be detached with one hand.

Another object of the present invention is to provide a buckle including actuating members which are movable smoothly and reliably to couple and release a male and female members and can be easily assembled with the female member in a stable manner.

According to the present invention, a buckle comprises a male member including a pair of locking elements, and a female member including a pair of actuating members movably mounted in the female member. The female member further includes a pair of retaining elements integral with the actuating members, respectively, and releasably engageable with the locking elements to couple the male and female members, and a resilient member disposed in the female member for urging each of the actuating members in one direction such that the locking elements and the retaining elements are firmly locked together. The actuating members are movable in the opposite direction against the resiliency of the resilient member to disengage the locking elements and the retaining elements. A force deflecting member is provided on one of the male and female members for deflecting a resilient force of the resilient member toward a direction of removal of the male member from the female member so that when the locking elements are disengaged from the retaining elements in response to the movement of the actuating members in the opposite direction. The force deflection member is operated to thrust out the male member from the female member.

In a preferred embodiment, the resilient member has a generally Ω shape including a pair of resilient legs, and the force deflection member is a substantially triangular projection formed on the male member. The triangular projection is resiliently engageable with the legs of the resilient member to spread the legs.

The actuating members may be reciprocally movable along a straight path extending perpendicular to the direction of relative movement of the male member and the female member. Each of the actuating members has an elongated guide hole extending parallel to the path. The female member further has a pair of fixed guide projections slidably received in the elongated guide holes of the respective actuating members. A contact point between each of the actuating members and a corresponding one of the resilient legs of the resilient member is aligned with a longitudinal axis of the guide hole.

In another preferred. embodiment, the resilient member is slidably mounted in the female member and movable in a direction parallel to the direction of removal of the male member relative to the female member. The resilient member includes a pair of resilient legs curved toward each other and having a pair of curved outer surfaces, respectively, held in pressure contact with the actuating members. The force deflection member is formed by the resilient legs. The force deflection member is responsive to the movement of the actuating members toward the opposite direction to shift the resilient member in the direction of removal of the male member, thereby thrusting the male member out from the female member.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION OF THE PREFERRED EMBODIMENTS

Figure 1:
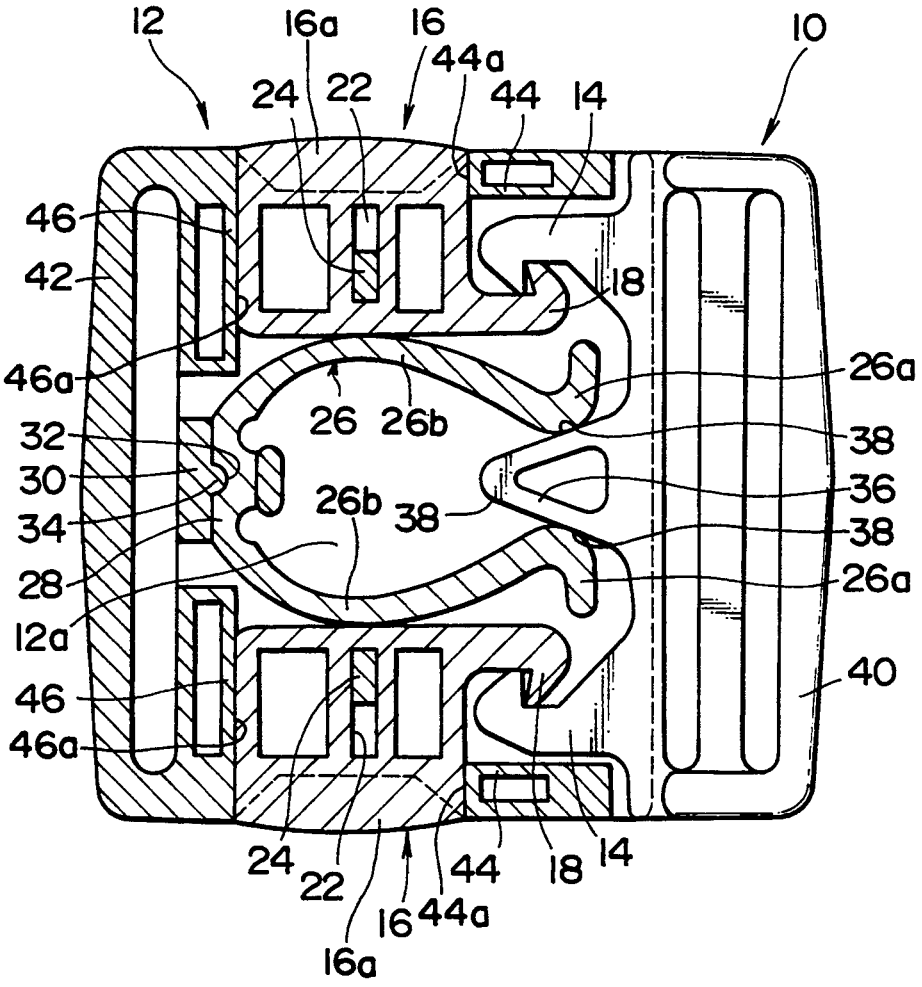
FIG. 1 is a plan view, partly in cross section, of a buckle according to a first embodiment of the present invention.

Referring now to the drawings, wherein like reference characters designate like or corresponding parts throughout the several views, FIG. 1 shows a buckle according to a first embodiment of the present invention. The buckle comprises a male or plug member 10 and a female or socket member 12 releasably coupled with the male member 10. The male member 10 is adapted to be connected to one end portion of a belt or strap (not shown), while the female member 12 is adapted to be connected to the opposite end portion of the belt or to a strap end portion on an article such as a bag (not shown). The male and female members 10 and 12 are made of metal or molded of synthetic resin.

Figure 3:
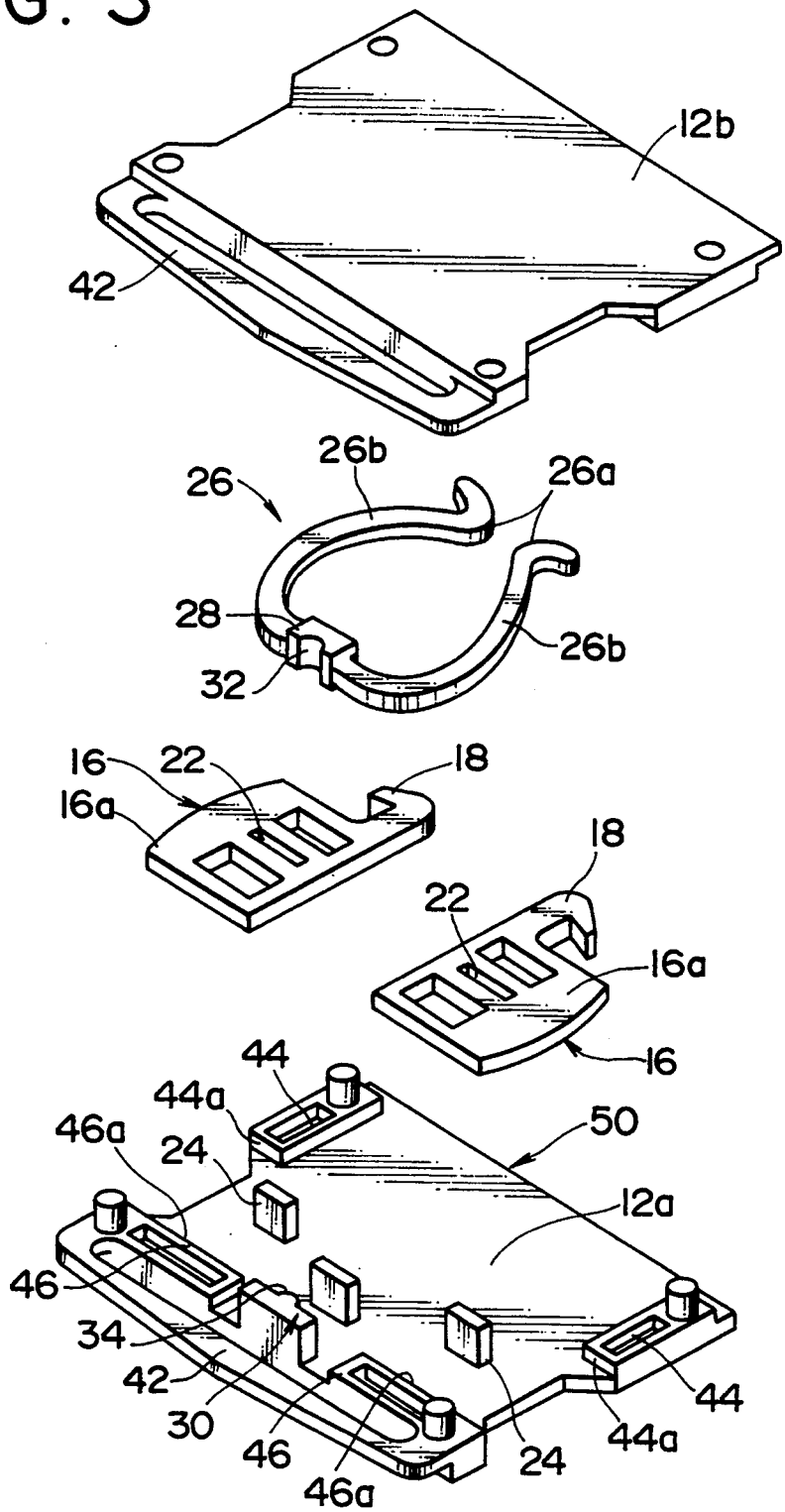
FIG. 3 is an exploded perspective view of the female member of the buckle.

The male member 10 includes a pair of parallel spaced hook-like locking elements 14. As shown in FIG. 3, the female member 12 is composed of a substantially rectangular base plate or body **12*a* and a substantially rectangular cover plate 12*b* which are assembled together, with a space defined between the base plate 12*a* and the cover plate 12*b*. A pair of actuating members 16, 16 is movably mounted in the female member 12 such that the actuating members 16 are slidable in a direction perpendicular to the direction of movement of the male member 10 relative to the female member 12. Each of the actuating members 16 is composed of a substantially rectangular flat body 16*a* and a hook-like retaining portion or element 18 projecting from an end of the body 16***a* in a direction opposite to the direction of insertion of the male member 10. The retaining element 18 is releasably engageable with a corresponding one of the locking elements 14 to couple the male and female members 10 and 12.

Each of the actuating members 16 has an elongated guide hole 22 formed in a central portion of the actuating member 16. The guide hole 22 extends in a direction perpendicular to the longitudinal axis of the hook-like retaining element 18, so as to define the direction and scope of the movement of the actuating member 16. The guide hole 22 is slidably fitted with a guide lug or projection 24 upstanding from the inside surface of the base plate 12*a* (FIG. 3). With this combination of the elongated guide hole 22 and the guide projection 24, the actuating member 16 is stably movable in the longitudinal direction of the guide hole 22 between a retracted position (standby position) in which an inner end of the guide hole 22 is held in abutment with the guide projection 24, and an advanced position (actuating position) in which the outer end of the guide hole 22 is held in abutment with the guide projection 24. The actuating members 16 are disposed in symmetrical relation to one another about a central axis of the female member 12 extending parallel to the direction of movement (insertion/removal) of the male member 10. Thus, the actuating members 16 are slidably movable toward and away from each other while they are being stably guided by the respective guide holes 22 and the guide projections 24. The guide holes 22 may be replaced by a pair of guide surfaces which are formed respectively in the actuating members 16 and extend in a direction perpendicular to the longitudinal axes of the respective hook-like retaining element 18. The guide surfaces are so profiled as to define the direction and scope of the movement of the actuating members 16 in cooperation with the guide projections 24. In this context, a portion of the peripheral surface defining each of the elongate guide holes 22 forms a guide surface.

The female member 12 further has a generally Ω-shaped resilient member 26 disposed, in a somewhat inwardly distorted condition, between the actuating members 16. The Ω-shaped resilient member 26 engages diametrically opposite central portions of the inner surfaces of the actuating members 16 which are aligned with the longitudinal axis of the elongated guide holes 22. The resilient member 26 is made of metal or molded of synthetic resin. The resilient member 26 is mounted on the base plate 12*a*, with its central head portion 28 firmly fitted with a mounting portion 30 projecting from the inside surface of the base plate 12*a* (FIG. 3). The head portion 28 has a semi-cylindrical recess 32 which is complementary in contour to the shape of a semi-cylindrical projection 34 on the mounting portion 30. The recess 32 and the projection 34 are firmly fitted together. Opposite free end portions (distal end portions) 26*a*, 26*a* of the resilient member 26 are resiliently engageable with sloped side surfaces 38 of a substantially triangular, wedge-like projection 36 of the male member 10. The triangular projection 36 is disposed centrally between the locking elements 14, 14. When the male and female members 10, 12 are coupled together as shown in FIG. 1, the resilient member 26 is resiliently deformed such that central portions of the respective legs 26*b* of the resilient member 26 are inwardly compressed by the actuating members 16, and the free ends 26*a* of the resilient member 26 are spread by the triangular projection 36. With this arrangement, the resilient force of the thus deformed resilient member 26, which acts on the sloped surfaces 28 of the triangular projection 36, is converted into a force tending to thrust out the male member 10 from the female member 12. Thus, the triangular projection 36 serves as a force deflection means or member which deflects the resilient forces of the respective legs 26*b* of the resilient member 26 toward a direction directly opposite to the direction of insertion of the male member 10 relative to the female member 12.

Figure 2:
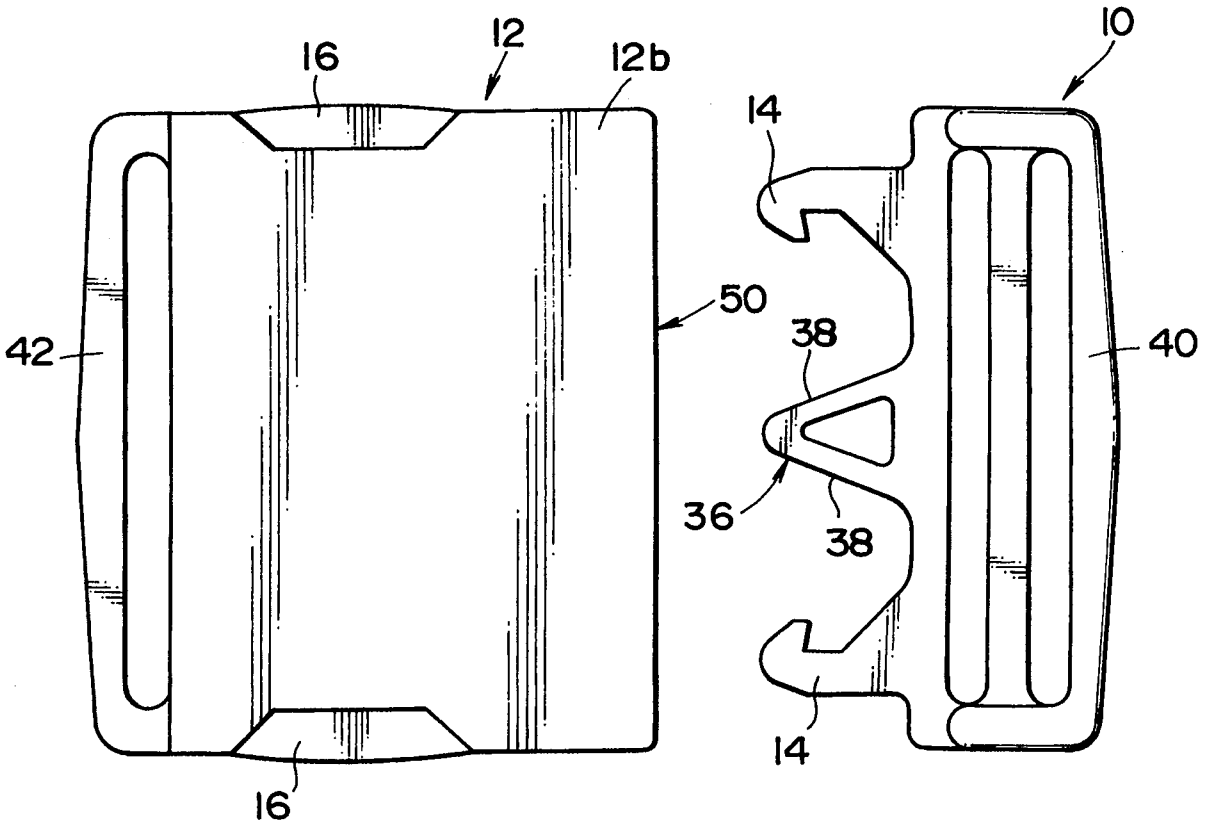
FIG. 2 a plan view of the buckle with a male member and a female member shown in a disengaged condition.

As shown in FIGS. 1 and 2, the male member 10 has an integral hollow connector frame of a rectangular shape for retaining thereon a loop of one belt end portion. Similarly, the female member 12 has an integral hollow connector frame 42 of a rectangular shape for retaining thereon a loop of the other belt end portion or a loop of a strap end portion of the article. As shown in FIGS. 1 and 3, the female member 12 further has a pair of parallel spaced side walls 44, 44 disposed adjacent an open end of the female member 12 and extending along opposite side edges of the base plate 12*a*, and a pair of longitudinally aligned end walls 46 disposed adjacent the connector frame 42. Each of the side walls 44 has an end surface 44*a* extending parallel to the longitudinal axis of a corresponding one of the elongated guide holes 22 of the actuating member 16. Each of the end walls 46 has a side surface 46*a* extending parallel to the end surface 44*a* of the corresponding one of the side walls 44. Each of the actuating members 16 is slidably received between the end surface 44*a* of one side wall 44 and the side surface 46*a* of the corresponding end wall 46. Thus, the actuating member 16 is guided at three points by means of the guide projection 24, the end surface 44*a* of the side wall 44, and the side surface 46*a* of the end wall 46. The thus guided actuating member 16 is slidable smoothly and stably without causing wobbling or producing a moment of force or torque. The side walls 44, the base plate 12*a*, and the cover plate 12*b* jointly define therebetween a central slot 50 for receiving therein the locking elements 14 and the triangular projection 36 of the male member 10.

The buckle of the foregoing construction is used in a manner described below.

To engage or couple the male and female members 10, 12 of the buckle as shown in FIG. 1, the male member 10 shown in FIG. 2 is inserted into the central slot 50 of the female member 12, with the locking elements 14 and the triangular projection 36 directed forward. In this instance, the locking elements 14 are brought into contact with the retaining elements 18, and a front end portion of the triangular projection 36 is located centrally between the free end portions 26*a* of the resilient member 26. As the locking elements 14 are further advanced, the retaining elements 18 and the actuating members 16 are displaced inwardly toward each other against the resiliency of the resilient member 26. A continuing advancing movement of the locking elements 14 brings the locking elements 14 to a snapping position in which the locking elements 14 and the retaining elements 18 snap together. When the locking elements 14 arrive at this snapping position, the resilient member 26 is allowed to expand or spring back to its original position with the result that the actuating members 16 are displaced outwardly away from each other by the resiliency of the resilient member 26. Thus, the locking elements 14 are snapped with the retaining elements 18 to lock the male and female members 10, 12 in a coupled condition shown in FIG. 1. In this coupled condition, the free end portions 26*a* of the resilient member 26 is somewhat spread by the triangular projection 36 of the male member 10.

To disengage the male and female members 10, 12, the actuating members 16 of the female member 12 are pressed by user's fingers against the resiliency of the resilient member 26. In this instance, since each of the actuating members 16 is guided at three points by means of the guide projection 24, the end surface 44*a* of the side wall 44, and the side surface 46*a* of the end wall 46, and since the substantially central portion of the inner surface of the actuating member 16 engages the resilient member 26, the actuating member 16 is able to slide smoothly and stably without causing wobbling. Thus, the sliding surfaces are completely free from local wear. As the actuating members 16 move inwardly, the respective legs 26*b* of the resilient member 16 are gradually flexed or bent toward each other with the result that the free end portions 26*a* slide on the sloped surfaces 38 of the triangular projection 36 toward the base of the triangular projection 36. The greater the amount of resilient deformation of the resilient member 26, the larger the amount of resilient forces exerted from the free end portions 26*a* of the resilient member 26 to the sloped surfaces 38 of the triangular projection 36. Further compressing of the actuating members 14 causes the retaining elements 18 to disengage from the locking elements 14. In this instance, the resilient forces exerted from the free end portions 26*a* of the resilient member 26 to the sloped surfaces 38 become maximum. Since the resilient forces are converted by the sloped surfaces 38 into a force tending to thrust out the male member 10 from the female member 12, as soon as the locking elements 14 are disengaged from the retaining elements 18, the male member 10 is thrust out from the female member 12 at least to such an extent that the free end portions 26*a* of the resilient member 26 are no longer possible to engage the sloped surfaces 38 of the triangular projection 36.

According to the first embodiment described above, the male member 10, as it is coupled with the female member 12, is urged in a direction away from the female member 12. Accordingly, the locking elements 14 are urged against the retaining elements 18 with the result that the male and female members 10, 12 are firmly locked in coupled condition against wobbling even when the buckle is subjected to an external force or vibration. In addition, when the actuating members 16 are pressed with user's fingers to disengage the locking elements 14 and the retaining elements 18, the male member 10 is automatically thrust out from the female member 12. The user can, therefore, accomplish the buckle disengaging operation easily and reliably with one hand. Furthermore, since the actuating members 16 are guided at three points by means of the guide projections 24, the end surfaces 44*a* of the side walls 44, and the side surfaces 46*a* of the end walls 46, and since the substantially central portions of the respective inner surfaces of the actuating members 16 are held in presser contact with the resilient member 26, the actuating members 16 are able to slide smoothly and stably without causing wobbling. Accordingly, the sliding surfaces and the coating films, if any, of the female member 12 are completely free from local wear. The actuating members 16 and the resilient member 26, as they are disposed in a preassembled condition on the base plate 12*a*, are stable in position and hence are unlikely to displace before the cover plate 12*b* is attached to the base plate 12*a*. The female member 12 can, therefore, be assembled reliably and efficiently.

Figure 4:
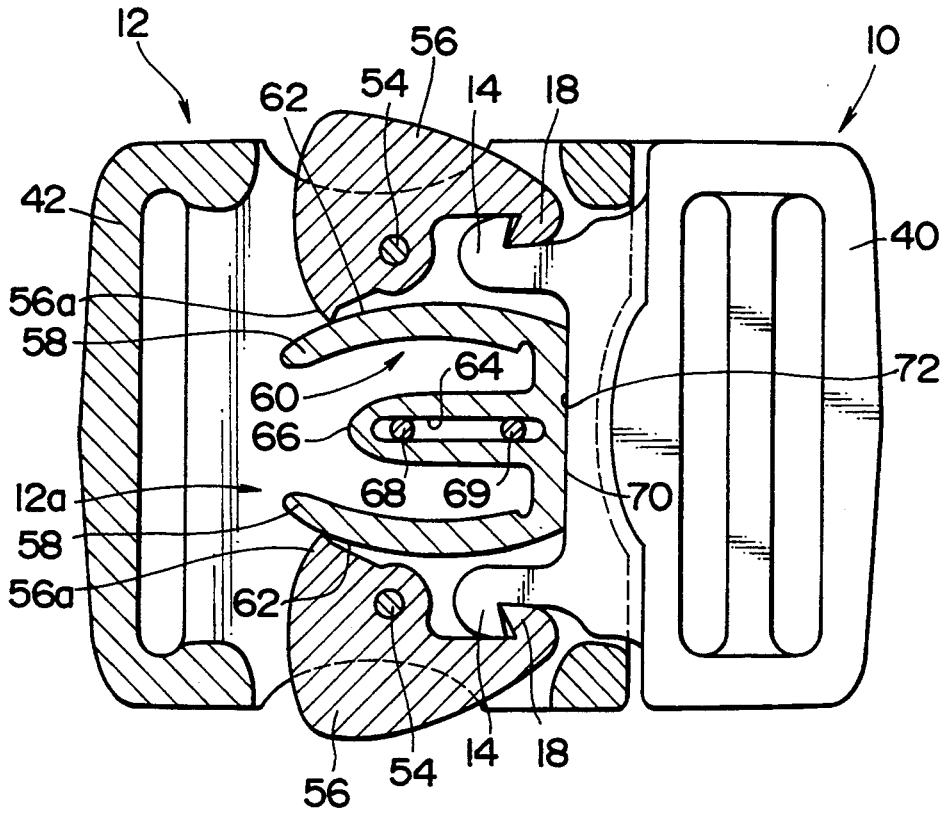
FIG. 4 is a view similar to FIG. 1 but showing a buckle according to a second embodiment of the present invention.

FIG. 4 shows a buckle according to a second embodiment of the invention. In FIG. 4, these parts which are identical to those in the first embodiment previously described are denoted by identical reference characters, and a further description thereof can, therefore, be omitted. The buckle in the second embodiment includes a pair of actuating members 56, 56 pivotally mounted on a pair of pivot pins 54, 54, respectively, projecting from the inside surface of a base plate 12*a* of a female member 12. Each of the actuating members 56 includes a hook-like retaining element 18 releasably engageable with one of two identical hook-like locking elements 14 of the male member 10 to lock the male and female members 10, 12 in coupled condition. A resilient member 60 is slidably mounted within the female member 12. The resilient member 60 is in the shape of a generally reversed E and includes a pair of curved or arcuate outer resilient legs 58, 58 and an elongated central attachment portion 66 disposed between the resilient legs 58. The resilient legs 58 serve also as force deflection members and, to this end, these legs 58 are curved toward each other and have respective curved outer surfaces 62 which are held in pressure contact with presser portions 56*a* of the respective actuating members 56. The presser portions 56*a* comprise a projection or ridge. The central attachment portion 66 has a longitudinally extending elongated guide hole 64 in which first and second guide pins 68 and 69 are slidably received. The guide pins 68, 69 project from the inside surface of the base plate 12*a* and they are properly spaced from one another to define opposite ends of reciprocating movement of the resilient member 60. The resilient member 60 has a flat front surface 70 extending perpendicular to a longitudinal axis of the guide hole 64 and facing toward an open end of the female member 12. The front surface 70 of the resilient member 60 is engageable with an abutment surface 72 of the male member 10.

When the male and female members 10, 12 of the buckle are to be coupled, the locking elements 14 of the male member 10 are forced into the female member 12. The locking elements 14, as they are advanced, first engage the retaining elements 18 of the actuating members 56 and then gradually displace the retaining elements 18 outwardly. With this outward displacement of the retaining elements 18, the actuating members 56 are turned about the pivot pins 54 in such directions that the respective presser portions 56*a* move toward each other. Thus, the legs 58 of the resilient member 60 are resiliently deformed or flexed toward each other. A continuing advancing movement of the locking elements 14 causes the locking elements 14 to snap with the retaining elements 18. In this instance, the legs 58 of the resilient member 60 are allowed to spring back to their original positions. Accordingly, the presser portions 56*a* are forced away from each other by the resiliency of the legs 58 so that the actuating members 56 turn in such directions that the retaining elements 18 are firmly interlocked with the locking elements 14, as shown in FIG. 4. Thus, the male and female members 10, 12 are firmly locked in coupled condition.

To disengage the male and female members 10, 12 of the buckle, the actuating members 56 are pressed with user's fingers against the resiliency of the resilient member 60, whereupon the actuating members 56 turn about the pivot pins 54 in such directions that the retaining elements 18 are disengaged from the locking elements 14. With this pivotal movement of the actuating members 56, the legs 58 of the resilient member 60 are resiliently flexed or deformed toward each other by the presser portions 56*a*. Further pressing of the actuating members 56 causes the retaining elements 18 to separate from the locking elements 14. In this instance, forces or pressures exerted from the presser portions 56*a* onto the curved outer surfaces 62 of the resilient legs 58 reach to a maximum. The forces or pressures applied to the curved outer surfaces 62 are converted by the curved outer surfaces 62 into forces tending shift the resilient member 60 toward an open end of the female member 12, thereby thrusting out the male member 10 from the female member 12. Accordingly, when the retaining elements 18 are released from the locking elements 14, the resilient members 60 is displaced toward the open end of the female member 12 until an end of the guide hole 64 abuts on the guide pin 68. With this movement of the resilient member 60, the male member 10 is thrust out from the female member 12. The extent or distance of projection of the male member 10 from the female member 12 is determined by the length of the guide hole 64 and the position of the guide pins 68, 69. The projecting distance must be long enough to provide a complete separation of the locking elements 14 and the retaining elements 18.

According to the second embodiment, when the male and female members 10, 12 of the buckle are coupled together, the resilient member 60 urges the presser portions 56*a* of the respective actuating members 56 to turn in such directions that the retaining elements 18 and the locking elements 14 are firmly locked together without wobbling. When the actuating members 60 are pressed to disengage the locking elements 14 and the retaining elements 18, the resilient member 60 moves in such a direction as to thrust out the male member 10 from the female member 12. Accordingly, the male and female members 10, 12 can be detached through a one-hand bucking disengaging operation.

Figure 5:
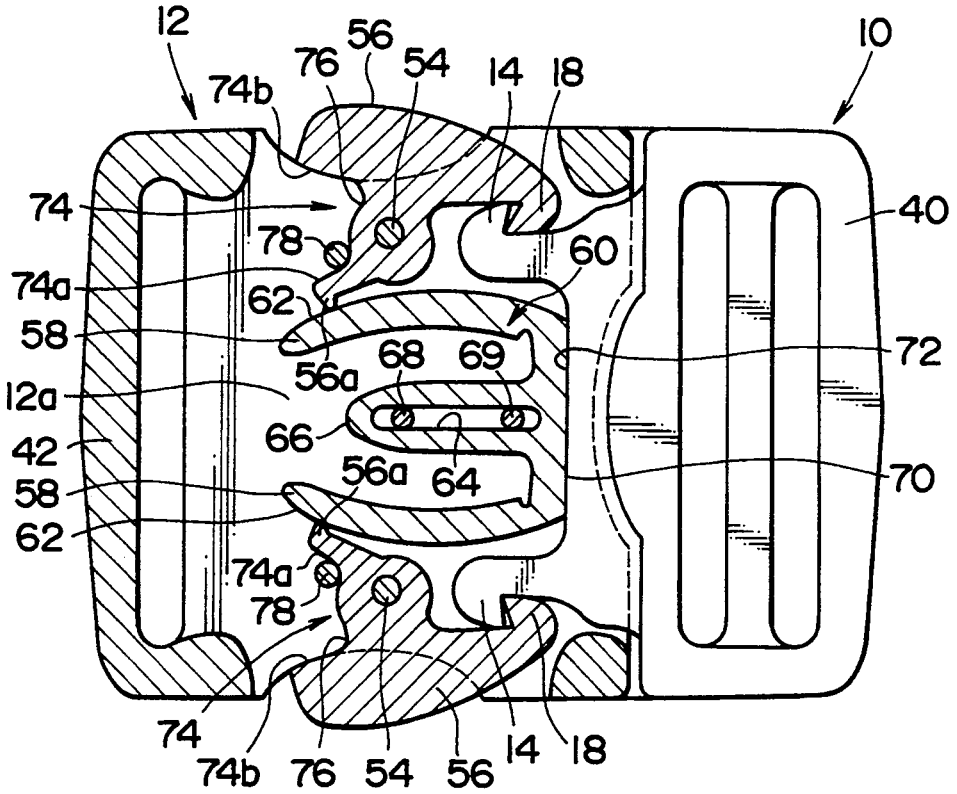
FIG. 5 is a view similar to FIG. 1, but showing a buckle according to a third embodiment of the present invention.

FIG. 5 shows a third embodiment of the present invention which has only one significant difference from the second embodiment previously described. The buckle in FIG. 5 is shown in the quiescent position comparable to the position of FIG. 4 for the second embodiment.

The significant difference between the buckle of FIG. 5 and the second embodiment is that each of the pivotally movable actuating members 56 has a recessed portion 74, and there is a stop pin 78 co-operative with the recessed portion 74 to limit the range of pivotal movement of the actuating member 56. The stop pin 78 projects from the inside surface of the base plate 12*a*. The recessed portion 74 includes a first stop surface 74*a* located at one end of the recessed portion 74 and engageable with the stop pin 78 to limit the pivotal movement of the actuating member 56 in one direction, and a second stop surface 74*b* located at the opposite end of the recessed portion 74 and engageable with the stop pin 78 to limit the pivotal movement of the actuating member 56 in the opposite direction, and a central arcuate guide surface 76 extending between the first and second stop surfaces 74*a*, 74*b* and slidably engageable with the stop pin 78 to stabilize the pivotal movement of the actuating member 56. The arcuate guide surface 76 is concentric with the corresponding pivot pin 54.

The opposite ends of the pivotal movement of each respective actuating member 56 is accurately defined by the stop pin 78 and the first and second stop surfaces 74*a*, 74*b*. In addition, during pivotal movement of the actuating member 56, the guide surface 76 is held in sliding contact with the stop pin 78. It is, therefore, possible to protect the resilient member 60 against damage which may otherwise occur when the actuating members 56 are subjected to undue pressure or forces. Furthermore, the stop pins 78 serve also as positioning pins when the actuating members 56 are assembled on the base plate 12*a* together with the resilient member 60. Thus, the female member can be assembled speedily and reliably.

The engaging and disengaging operations of the buckle are achieved in the same manner as the second embodiment previously described and hence a no further description is needed.

Figure 6:
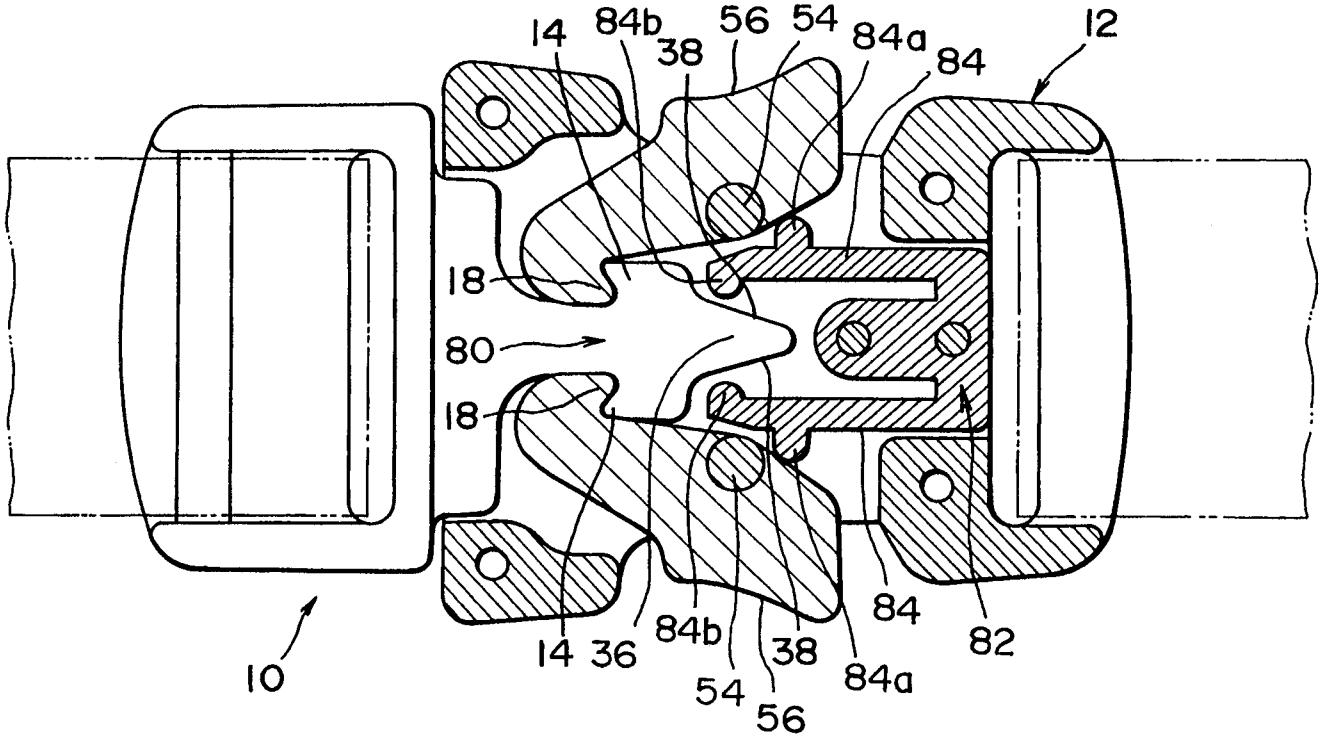
FIG. 6 is a plan view, partly in cross section, of a buckle according to a fourth embodiment of the present invention.

FIG. 6 shows a buckle according to a fourth embodiment of the present invention. A male member 10, constituting one part of the buckle, is substantially the same as the male member shown in FIG. 1 with the exception that a pair of locking elements 14, 14 is formed as flanks of a arrowhead-like locking member 80 projecting from a central portion of an end of the male member 10, and a triangular projection 36 serving as a force deflection member is formed as a tip of the arrowhead-like locking member 80. A female member 12, constituting the other part of the buckle, is similar to the female member shown in FIG. 4 but differs therefrom in that a generally reversed E-shaped resilient member 82 is fixedly mounted on the female member 12. The resilient member 82 has a pair of parallel spaced resilient legs 84, 84 each having a presser portion 84*a* projecting laterally outwardly from an intermediate portion thereof, and an enlarged free end 84*b* projecting laterally inwardly toward the enlarged free end 84*b* of the opposite leg 84. The presser portion 84*a* is engaged with a portion of the corresponding actuating member 56 which is located on the opposite side of a retaining portion 18 with respect to a pivot pin 54. Thus, the actuating members 56 are urged by the legs 84 of the resilient member 82 in a direction such as to move the respective retaining portions 18 toward each other. The enlarged free end 84*b* is slidably engageable with a corresponding one of the sloped side surfaces 38 of the triangular projection 36.

When the male and female members 10, 12 of the buckle just described above are to be coupled, the arrowhead-like locking member 80 is forced into the female member 12. As the locking member 80 advances, the triangular projection 36 and the locking elements 14 of the locking member 80 are successively brought into friction contact with the retaining elements 18 of the respective actuating members 56 during which time the retaining elements 18, 18 are gradually displaced outwardly away from each other, thereby turning the actuating members 56 in one direction about the respective pivot pins 54 against the resiliency of the legs 84 of the resilient member 80. With this pivotal movement of the actuating members 56, the legs 84 of the resilient member 82 are resiliently flexed or bent inwardly toward each other. The continued advancing movement of the locking member 80 causes the locking elements 14 to move past the tips of the retaining elements 18, whereupon the legs 84 are allowed to spring back to its original position, thereby turning the actuating members 56 in the opposite direction about the pivot pins 54 by the resilient forces stored in the legs 84. With this pivotal movement of the actuating members 56, the locking elements 14 are snapped with the retaining elements 18.

Thus, the male and female members 10, 12 are firmly coupled together, as shown in FIG. 6.

To disengage the male and female members 10, 12 of the buckle, the actuating members 56 are pressed inwardly of the female member 12 by the user's fingers against the resiliency of the legs 84 of the resilient member 82. With this pivotal movement of the actuating members 56, the legs 84 are resiliently flexed or bent inwardly via the presser portions 84*a* so that the enlarged free end portions 84*b* are brought into contact with the sloped side surfaces 38 of the triangular projection 36. Further pressing of the actuating member 56 causes the retaining elements 18 to be disengaged from the locking elements 14. In this instance, the resilient forces exerted from the free end portions 84*b* of the legs 84 to the sloped surfaces 38 of the triangular projection 36 become maximum. The thus exerted resilient forces are converted by the sloped surfaces 38 into a force tending to thrust out the male member 10 from the female member 12. Accordingly, upon separation of the locking elements 14 and the retaining elements 18, the male member 10 is thrust out from the female member 12. The extent or distance to which the male member 10 projects from the female member 12 is determined by the length of the sloped side surfaces 38. The projecting distance must be long enough to insure continued sliding engagement between the sloped side surfaces 38 and the free end portions 84*b* of the legs 84 for a short period of time after the complete separation of the locking elements 14 and the retaining elements 14 takes place.

According to the fourth embodiment just described above, the arrowhead-like locking member 80 is located at a central portion of the male member 10 and has formed integrally therewith the locking elements 14. The male member 10 having such locking projection 80 can be smoothly inserted into the female member 12. In addition, the arrowhead-like locking member 30 is structurally rigid. Furthermore, as a result of the location of the locking member 80, the retaining members 18 and the locking elements 14 are brought into interlocking engagement with each other substantially at a central portion of the buckle. Accordingly, the male and female members 10, 12 can be locked together without tilting even when one of the locking elements 14 is released from the corresponding retaining element 18 due to some reasons. A further advantages attainable by the centrally located locking member 80 is that the male member 10 and hence the buckle as a whole can be constructed into a slender shape, which shape is particularly suitable when the buckle is used with a narrow belt or strap.

Figure 7:
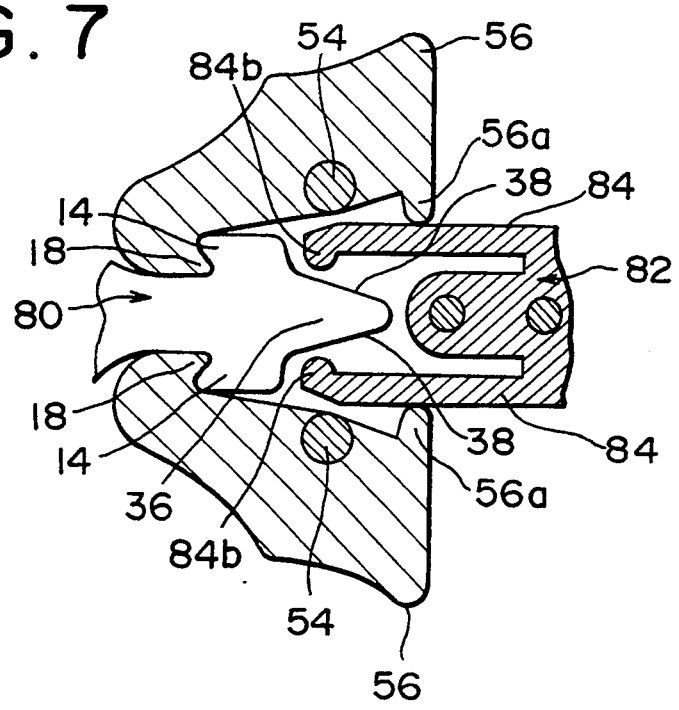
FIG. 7 is a fragmentary plan view, partly in cross section, of a buckle according to a fifth embodiment of the present invention.

FIG. 7 shows a fifth embodiment of the present invention which has only one diffidence from the fourth embodiment described above. The difference between the buckle of FIG. 7 and the fourth embodiment is that projection-like presser portions 56*a* are provided on the respective actuating members 56 and not on the resilient legs 84. With the presser portions 56*a* thus provided, the resilient forces of the respective legs 84 can reliably be transmitted to actuating members 56.

Figure 8:
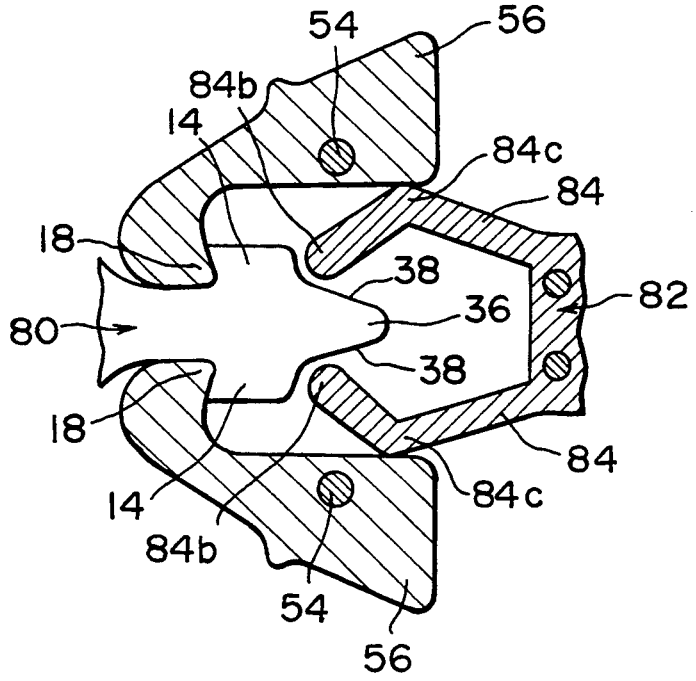
FIG. 8 is a view similar to FIG. 7, but showing a sixth embodiment of the present invention.

FIG. 8 illustrates a sixth embodiment of the present invention which differs from the fourth embodiment of FIG. 6 in that each of the legs 84 of the resilient member 82 is bent outwardly at a central portion into a somewhat flattened L-shape. The outwardly bent central portion 84*c* is held in contact with a portion of the corresponding actuating member 56 so that the resilient force of each leg 82 can be transmitted with reliability to the corresponding actuating member 56.

Obviously, various modifications and variations of the present invention are possible in the light of the above teaching. For example, the male member and the resilient member in the first embodiment may be combined with the actuating members in the second or the third embodiment. Yet, the actuating members in the first embodiment may be applied to the second embodiment. Additionally, the shape and configuration of the actuating members, the resilient member, the locking elements and the retaining elements should be construed as illustrative rather than restrictive. It is therefore to be understood that within the scope of the appended claims the invention may be practiced otherwise than as specifically described.

What is claimed is:

1. A buckle for fastening two end portions of an article, comprising:

(a) a male member adapted to be connected to one of the end portions of the article and including a pair of locking elements;

(b) a female member adapted to be connected to the other end portion of the article and including a pair of actuating members movably mounted in said female member, a pair of retaining elements integral with said actuating members, respectively, and releasably engageable with said locking elements to couple said male and female members, and a resilient member disposed in said female member for urging each of said actuating members in one direction such that said locking elements and said retaining elements are firmly locked together, said actuating members being movable in the opposite direction against the resiliency of said resilient member to disengage said locking elements and said retaining elements; and (c) a force deflecting member provided on one of said male and female members for deflecting a resilient force of said resilient member toward a direction of removal of said male member from said female member so that when said locking elements are disengaged from said retaining elements in response to the movement of said actuating members in said opposite direction, said force deflection member is operated to thrust out said male member from said female member.

2. A buckle according to claim 1, wherein said resilient member is fixedly mounted on said female member and includes a pair of resilient legs having a pair of free ends, respectively, and wherein said force deflection member is a substantially triangular projection formed on said male member and resiliently engageable with said legs of said resilient member, said triangular projection having two sloped side surfaces slidably engageable with said free end portions of said resilient legs.

3. A buckle according to claim 2, wherein said locking elements are substantially hook-like shape and separated from each other, and said triangular projection is disposed centrally between said hook-like locking elements.

4. A buckle according to claim 2, wherein said locking elements and said triangular projection are integral with each other and jointly form an arrowhead-like locking member projecting from a central portion of said male member, said locking elements forming flanks of said arrowhead-like locking member, said triangular projection forming a tip of said arrowhead-like locking member.

5. A buckle according to claim 2, wherein said actuating members are reciprocally movable along a path extending perpendicular to the direction of movement of said male member relative to said female member, said actuating members being normally held in pressure contact with said resilient legs of said resilient member.

6. A buckle according to claim 5, wherein said actuating members have a pair of aligned elongated guide holes, respectively, extending along said path of reciprocating movement of said actuating members, and said female member further has a pair of fixed guide projections slidably received respectively in said elongated guide holes of said actuating members.

7. A buckle according to claim 6, wherein each of said actuating members and a corresponding one of said resilient legs of said resilient member have a contact point, said contact point being aligned with a longitudinal axis of said guide hole.

8. A buckle according to claim 7, wherein said female member further has two pairs of confronting guide surfaces, each of said actuating members being guidedly received between a corresponding one of said two pairs of confronting guide surfaces.

9. A buckle according to claim 2, wherein said actuating members are pivotally mounted on said female member by means of a pair of pivot pins, respectively.

10. A buckle according to claim 9, wherein said legs of said resilient member extend parallel with each other and have a pair of presser projections, respectively, which are engaged with portions of said actuating members located opposite said retaining elements across said pivot pins.

11. A buckle according to claim 9, wherein said legs of said resilient member extend parallel with each other, and said actuating members have a pair of presser projections located opposite said retaining elements across said pivot pins, said presser projections being held in pressure contact with intermediate portions of the respective legs of said resilient member.

12. A buckle according to claim 9, wherein said legs of said resilient member have a somewhat flattened L-shape and include a pair of outwardly bent intermediate portions, respectively, said bent intermediate portions being engaged with portions of said actuating members which are located opposite said retaining elements across said pivot pins.

13. A buckle according to claim 1, wherein said resilient member is slidably mounted in said female member and movable in a direction parallel to said direction of removal of said male member relative to said female member, said resilient member including a pair of resilient legs curved toward each other and having a pair of curved outer surfaces, respectively, held in pressure contact with said actuating members, and wherein said force deflection member is formed by said resilient legs, said force deflection member being responsive to the movement of said actuating members toward said opposite direction to shift said resilient member in said direction of removal of said male member, thereby thrusting said male member out from said female member.

14. A buckle according to claim 13, wherein said resilient member has a generally E shape and including an elongated central attachment portion disposed between said resilient legs, said attachment portion has a longitudinal elongated guide hole extending parallel to the direction of movement of said male member relative to said female member, said female member further including a pair of guide pins slidably received in said guide hole in said attachment portion for limiting opposite ends of the movement of said resilient member.

15. A buckle according to claim 13, wherein said actuating members are pivotally mounted on said female member by means of a pair of pivot pins, respectively.

16. A buckle according to claim 15, wherein said actuating members have a pair of presser projections, respectively, located opposite said retaining elements across said pivot pins, said presser projections being held in pressure contact with said curved outer surfaces of the respective resilient legs of said resilient member.

17. A buckle according to claim 15, wherein each of said actuating members has a recessed portion, said female member further having a pair of stop pins, each of said stop pins being co-operative with said recessed portion to limit the range of pivotal movement of said actuating member.

18. A buckle according to claim 17, wherein said recessed portion includes a first stop surface located at one end of said recessed portion and engageable with a corresponding one of said stop pins to limit the pivotal movement of said actuating member in said one direction, a second stop surface located at an opposite end of said recessed portion and engageable with said corresponding stop pin to limit the pivotal movement of said actuating member in said opposite direction, and an arcuate guide surface extending between said first and second stop surfaces and slidably engageable with said corresponding stop pin, said arcuate guide surface being concentrical with an pivot axis of said actuating member.

19. A buckle for fastening two end portions of an article, comprising:

(a) a male member adapted to be connected to one of the end portions of the article and including a pair of locking elements; and (b) a female member adapted to be connected to the other end portion of the article and including a pair of actuating members movably mounted in said female member, a pair of retaining elements integral with said actuating members, respectively, and releasably engageable with said locking elements to couple said male and female members, and a resilient member disposed in said female member for urging each of said actuating members in one direction such that said locking elements and said retaining elements are firmly locked together, said actuating members being movable in the opposite direction against the resiliency of said resilient member to disengage said locking elements and said retaining elements, each of said actuating members having an elongated guide surface extending parallel to the direction of movement of said actuating member, said female member further having a pair of fixed guide projections slidably engaged with said elongated guide surfaces of the respective actuating members, said guide surfaces and said guide projections being cooperative to define the direction and the range of movement of said actuating members.

20. A buckle according to claim 19, wherein said actuating members have a pair of aligned elongated guide holes, respectively, extending parallel to the direction of movement of said actuating member and slidably receiving therein said guide projections, each of said actuating members and a corresponding one of said resilient legs of said resilient member having a contact point, said contact point being aligned with longitudinal axes of said guide holes.

21. A buckle according to claim 20, wherein said female member further has two pairs of confronting guide surfaces, each of said actuating members being guidedly received between a corresponding one of said two pairs of confronting guide surfaces.

22. A buckle according to claim 20, wherein said actuating members are reciprocally movable toward and away from each other.

23. A buckle according to claim 19, wherein said actuating members are pivotally mounted on said female member and having a pair of recessed portions, respectively, each of said recessed portion including a first stop surface located at one end of said recessed portion and engageable with a corresponding one of said stop pins to limit the pivotal movement of said actuating member in said one direction, a second stop surface located at an opposite end of said recessed portion and engageable with said corresponding stop pin to limit the pivotal movement of said actuating member in said opposite direction, and an arcuate guide surface extending between said first and second surfaces and slidably engageable with said corresponding stop pin, said arcuate guide surface being concentrical with an pivot axis of said actuating member.

* * * * *